US007539440B2

(12) United States Patent
Tamura

(10) Patent No.: US 7,539,440 B2
(45) Date of Patent: May 26, 2009

(54) MAGNETIC MONOCOMPONENT DEVELOPER AND IMAGE FORMING METHOD

(75) Inventor: Hidekazu Tamura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 419 days.

(21) Appl. No.: 11/406,655

(22) Filed: Apr. 19, 2006

(65) Prior Publication Data

US 2006/0240348 A1 Oct. 26, 2006

(30) Foreign Application Priority Data

Apr. 21, 2005 (JP) ..... 2005-123908

(51) Int. Cl.
*G03G 9/083* (2006.01)

(52) U.S. Cl. ..... 399/119; 430/110.3; 430/110.4

(58) Field of Classification Search ..... 399/119; 430/110.3, 110.4
See application file for complete search history.

(56) References Cited

U.S. PATENT DOCUMENTS

| | | | | |
|---|---|---|---|---|
| 6,453,138 | B1 * | 9/2002 | Inoue et al. | 399/159 |
| 2001/0018157 | A1 * | 8/2001 | Aoki et al. | 430/109.4 |
| 2005/0139701 | A1 * | 6/2005 | Naka et al. | 241/5 |
| 2005/0227157 | A1 * | 10/2005 | Shirai | 430/106.1 |
| 2008/0213686 | A1 * | 9/2008 | Nagai | 430/119.82 |

FOREIGN PATENT DOCUMENTS

| | | | |
|---|---|---|---|
| JP | 2003302787 | * | 10/2003 |
| JP | 04-177754 A | | 6/2004 |

OTHER PUBLICATIONS

Machine English language translation of JP 2003302787. Oct. 2003.*
Abstract of JP 2003302787. Oct. 2003.*

* cited by examiner

*Primary Examiner*—Hoa V Le
(74) *Attorney, Agent, or Firm*—Carmody & Torrance LLP

(57) ABSTRACT

The present invention provides a magnetic monocomponent developer which can obtain a stable conveying performance for a long period and an image forming method which uses the developer. In a magnetic monocomponent developer which is used in a developing unit which includes a developing vessel which accommodates a magnetic monocomponent developer therein, a developer carrying body which carries the magnetic monocomponent developer and conveys the magnetic monocomponent developer to a developing region, and a developer layer thickness restricting member which restricts a layer thickness of the magnetic monocomponent developer, the magnetic monocomponent developer includes toner particles which contain at least a binder resin and magnetic powder, and also includes following constitutions (a) to (c).

(a) an average particle size of the toner particles may being set to a value which falls within a range from 6 to 9 μm.

(b) an average degree of circularity of the toner particles being set to a value which falls within a range from 0.950 to 0.960.

(c) a content of the toner particles having a degree of circularity of below 0.850 being set to a value which falls within a range from 2.0 to 4.0 unit % with respect to a total quantity of the toner particles.

6 Claims, 12 Drawing Sheets

(a)

(b)

MAGNETIC MONOCOMPONENT DEVELOPER AND IMAGE FORMING METHOD

TECHNICAL FIELD

The present invention relates to a magnetic monocomponent developer (also simply referred to as "developer" hereinafter) and an image forming method which uses the magnetic monocomponent developer.

Particularly, the present invention relates to a magnetic monocomponent developer which can acquire stable conveying performance for a long period even when the magnetic monocomponent developer is used in a developing unit which includes a spiral member as an agitating and conveying means of a developer and an image forming method which uses the magnetic monocomponent developer.

RELATED ART

A developing method adopted by an image forming apparatus such as a copying machine, a printer, a facsimile, a composite machine thereof or the like which uses an electrophotographic method is classified into a monocomponent developing method which uses a monocomponent developer and a two-component developing method which uses a two-component developer.

However, since the two-component developing method uses carrier and requires a mechanism which controls a mixing ratio of toner and carrier, the miniaturization and the reduction of weight of the image forming apparatus are difficult. Accordingly, the monocomponent developing method is considered suitable to cope with a demand for the miniaturization, the reduction of weight and the low power consumption along with the recent personalization of the image forming apparatus.

Such image forming apparatus includes a developing unit for developing a photoreceptor on which a latent image is formed. The developing unit is constituted of a developer carrying body which carries the developer thereon and a conveying member which conveys the developer to a surface of the developer carrying body, wherein the developer is constantly moved in the inside of the developing unit without dwelling.

When the fluidity of the developer is lowered in the inside of the developing unit, there may arise a drawback that the developer is liable to easily dwell in the inside of an accommodating vessel. As a result, when the image forming apparatus is used for a long period in such a state, the developer which dwells in the inside of the vessel unit aggregates and the aggregated developer adheres to a conveying member thus giving rise to abnormal images such as fogging.

Accordingly, to overcome such a drawback, there has been proposed an image forming apparatus which includes a toner collapsing member for loosening the aggregated toner (see patent document 1, for example).

To be more specific, as shown in FIG. 12, in a toner recycle mechanism 300, a toner collapsing member 282 is formed of a resilient film sheet (PET film sheet) and includes a tongue which is deformed when a force is imparted thereto from the outside at the time of rotating a rotary propelling conveying means 281 which has a spiral shape. Then, the aggregated toner is collapsed by the toner collapsing member which includes the tongue thus preventing the aggregation of the toner.

[Patent document 1] JP2004-177754A (Claims)

DISCLOSURE OF THE INVENTION

Problems to be Solved by the Invention

However, in the image forming apparatus described in patent document 1, when a use environment such as temperature and moisture is changed, characteristics of toner particles and the toner collapsing member are respectively changed along with the change of the use environment and hence, there has been a possibility that a shape of toner particles is changed and, depending on conditions, the fluidity of the toner is remarkably lowered thus giving rise to a drawback that the toner is liable to be easily aggregated.

The present invention has been made to overcome such drawbacks and inventors of the present invention have found that with the use of a magnetic monocomponent developer in which an average particle size of toner particles, an average degree of circularity of the toner particles and a content of the toner particles having a predetermined degree of circularity are respectively set to values which fall within predetermined ranges, stress resistance of the toner particles is enhanced and hence, even when a use environment is changed, a drawback that the fluidity of the toner is lowered can be overcome and have completed the present invention.

That is, it is an object of the present invention to provide a magnetic monocomponent developer which can obtain excellent image characteristics even under an environment in which stress is applied to toner particles and an image forming method which uses such a magnetic monocomponent developer.

According to the present invention, there is provided a magnetic monocomponent developer which is used in a developing unit which includes a developing vessel which accommodates the magnetic monocomponent developer therein, a developer carrying body which carries the magnetic monocomponent developer and conveys the magnetic monocomponent developer to a developing region, and a developer layer thickness restricting member which restricts a layer thickness of the magnetic monocomponent developer, wherein the magnetic monocomponent developer includes toner particles which contain at least a binder resin and magnetic powder, and also includes following constitutions (a) to (c). With the use of such a magnetic monocomponent developer, it is possible to overcome the above-mentioned drawbacks.

(a) an average particle size of the toner particles may being set to a value which falls within a range from 6 to 9 μm.

(b) an average degree of circularity of the toner particles being set to a value which falls within a range from 0.950 to 0.960.

(c) a content of the toner particles having a degree of circularity of below 0.850 being set to a value which falls within a range from 2.0 to 4.0 unit % with respect to a total quantity of the toner particles.

That is, with the use of the magnetic monocomponent developer in which the average particle size, the average degree of circularity and the content of the toner particles having the predetermined degree of circularity are set to values which fall within respective predetermined ranges, the stress resistance of the toner particles is enhanced whereby even when a use environment is changed, the toner no more aggregates and can maintain the excellent fluidity.

Further, in forming the magnetic monocomponent developer of the present invention, it is preferable that a content of the toner particles having the particle size of 5 μm or less is set to a value which falls within a range of 20 volume % or less with respect to a total quantity of the toner particles.

By forming the magnetic monocomponent developer in this manner, it is possible to control the content of the particles which have the particularly small particle size and hence, the aggregation of the toner can be effectively prevented.

Further, in forming the magnetic monocomponent developer of the present invention, it is preferable that the binder resin contains a first binder resin having a weight average molecular weight peak within a range from $1.0\times10^4$ to $5.0\times10^4$ and a second binder resin having a weight average molecular weight peak within a range from $1.0\times10^6$ to $5.0\times10^6$.

By forming the magnetic monocomponent developer in this manner, it is possible to allow the binder resin to exhibit both of the heat resistance which the binder resin having the relatively large molecular weight possesses and the fixing property which the binder resin having the relatively small molecular weight possesses in a well-balanced manner.

Further, in forming the magnetic monocomponent developer of the present invention, it is preferable that a softening point of the first binder resin is set to below 120° C. and, at the same time, a softening point of the second binder resin is set to 120° C. or more.

By forming magnetic monocomponent developer in this manner, it may be possible to provide the developer which exhibits the excellent fixing property and the excellent heat resistance in addition to the stress resistance.

Further, in forming the magnetic monocomponent developer of the present invention, it is preferable that the toner particles are formed by a pulverizing method.

By forming magnetic monocomponent developer in this manner, it may be possible to easily control the values of the average particle size and the average degree of circularity within the above-mentioned ranges and, at the same time, it is possible to control the distributions of these average particle size and the average degree of circularity thus producing the developer which exhibits the excellent fluidity.

Further, in forming the magnetic monocomponent developer of the present invention, it is preferable that the first binder resin and the second binder resin are respectively formed of a first polyester resin and a second polyester resin, wherein an acid value of the first polyester resin is below 6 mgKOH/g and, at the same time, an acid value of the second polyester resin is equal to or above 6 mgKOH/g.

By forming the magnetic monocomponent developer in this manner, it may be possible to enhance the compatibility of the plurality of polyester resins and, at the same time, it may be possible to acquire balance between the further excellent stress resistance and the further excellent fixing property in a stable manner.

Further, in forming the magnetic monocomponent developer of the present invention, it is preferable that the toner further contains hydrophobic silica as an additive agent and, at the same time, an addition quantity of the hydrophobic silica is set to a value which falls within a range from 0.5 to 2.0 weight % with respect to the total quantity of the toner.

Due to such a formation of the toner, it may be possible to acquire the further enhanced balance among stress resistance, fixing property and fluidity.

Further, according to another aspect of the present invention, there is provided an image forming method which is characterized in that the image forming method uses any one of the above-mentioned magnetic monocomponent developers to a developing unit which includes an agitating and conveying means for conveying the toner particles in the rotary axis direction.

That is, with the use of the magnetic monocomponent developer which satisfies the prescribed conditions in the developing unit which includes the agitating and conveying means, the stress resistance of the toner particles is enhanced and hence, even when the use environment may be changed, the toner no more aggregates and can maintain the excellent fluidity. Accordingly, even under an environment where the magnetic monocomponent developer is liable to receive stress, the magnetic monocomponent developer can maintain the fluidity, the heat resistance and the fixing property thus realizing an image of high quality.

Further, in carrying out the present invention, it is preferable that the agitating and conveying means includes a spiral member which has a spiral blade.

By carrying out the method using such an agitating and conveying means, the agitating and conveying means can exhibit an excellent toner particles agitating function. Further, with the use of the developer of the present invention, even when the developing unit having such a spiral member is used, there is no possibility that the toner adheres to a surface of the blade and lowers the fluidity of the toner.

BEST MODE FOR CARRYING OUT THE INVENTION

First Embodiment

Figure 1:
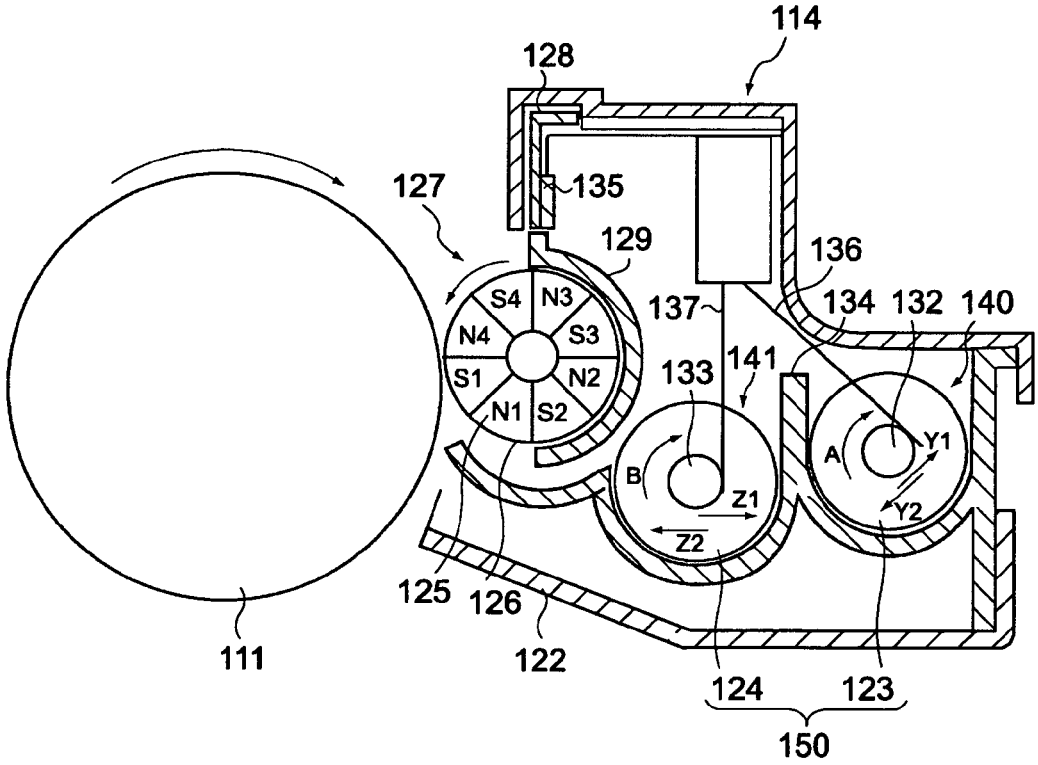
FIG. 1 is a schematic view showing a developing unit of the first embodiment.

The first embodiment is directed to a magnetic monocomponent developer which is used in a developing unit which includes a developing vessel which accommodates the magnetic monocomponent developer therein, a developer carrying body which carries the magnetic monocomponent developer and conveys the magnetic monocomponent developer to a developing region, and a developer layer thickness restricting member which restricts a layer thickness of the magnetic monocomponent developer, wherein the magnetic monocomponent developer includes toner particles which contain at least a binder resin and magnetic powder, and also includes following constitutions (a) to (c).

(a) An average particle size of the toner particles may be set to a value which falls within a range from 6 to 9 μm.

(b) An average degree of circularity of the toner particles is set to a value which falls within a range from 0.950 to 0.960.

(c) A content of the toner particles having a degree of circularity of below 0.850 is set to a value which falls within a range from 2.0 to 4.0 unit % with respect to a total quantity of the toner particles.

Hereinafter, the developer and the developing unit which uses the developer are explained respectively in view of respective constitutional elements thereof.

1. Basic Constitution of Developer

As the basic constitution of a developer which is used in the first embodiment, inorganic fine particles may preferably be added to toner particles which are formed of the binder resin, the waxes, a charge controlling agent and magnetic powder.

(1) Binder Resin (1)-1 Kind

Although a kind of the binder resin which is used for toner particles in the first embodiment is not particularly limited, it is preferable to use a thermoplastic resin such as, for example, a styrene resin, an acrylic resin, styrene-acrylic copolymer, a polyethylene resin, a polypropylene resin, a vinyl chloride resin, a polyester resin, a polyamide resin, a polyurethane resin, a polyvinyl alcohol resin, a vinyl ether resin, a N-vinyl resin, a styrene-butadiene resin or the like.

Further, it is preferable that the binder resin is a cross-linked material and, at the same time, the binder resin contains 5 to 30 weight % of tetrahydrofuran insoluble component with respect to the total quantity of the binder resin.

The reason is that, by using these cross-linked materials, it is possible to obtain the excellent balance between aggregation resistance and fixing property which conflict to each other as the developer.

(1)-2 Average Molecular Weight

Further, in the binder resin, it is preferable that the binder resin contains a plurality of binder resins and, at the same time, a first binder resin in which a weight average molecular weight peak is set to a value which falls within a range from $1.0\times10^4$ to $5.0\ \ 10^4$, and a second binder resin in which a weight average molecular weight peak is set to a value which falls within a range from $1.0\times10^6$ to $5.0\times10^6$, for example.

That is, in the molecule weight distribution of the binder resin, it may be preferable that the binder resin has two molecular weight peaks (sometimes referred to as low molecular weight peak and high molecular weight peak).

The reason is that when these two molecular weight peaks are respectively set to values which fall within the predetermined ranges, it may be possible to obtain excellent fixing property, while heat resistance becomes favorable and hence, in a high speed image forming apparatus provided with a developing unit having a spiral member or the like, even when printing is sequentially carried out at a high temperature and under a high moisture, it may be possible to effectively prevent drawbacks such as toner aggregation due to temperature elevation of the machine or the developing unit or the like.

Accordingly, it may be preferable to set the low molecular weight peak to a value which falls within a range from $2.0\times10^4$ to $4.0\times10^4$ and to set the high molecular weight peak to a value which falls within a range from $2.0\times10^6$ to $4.0\times10^6$.

Figure 4:
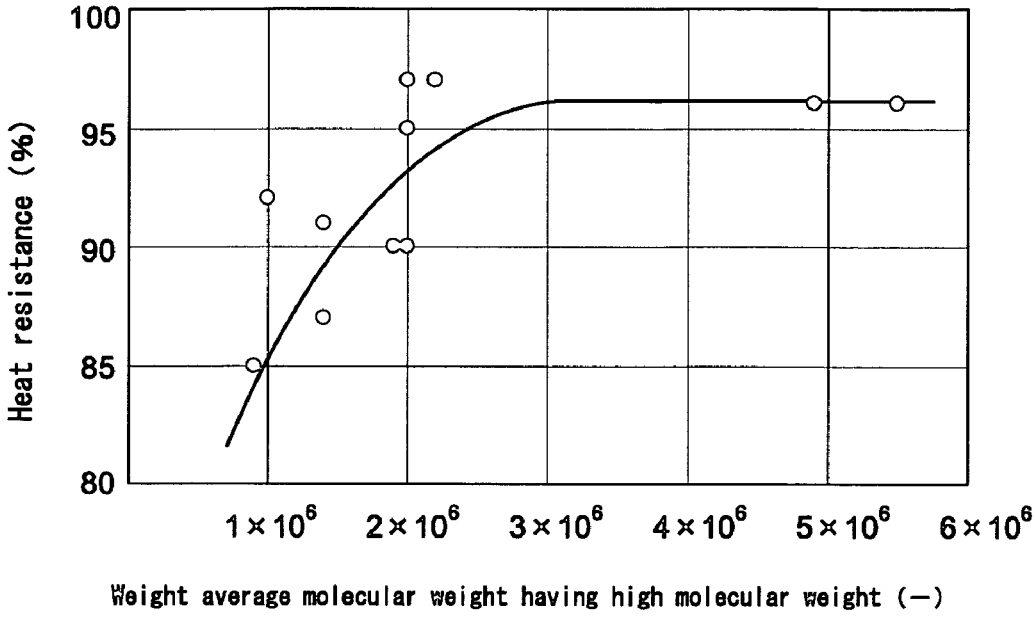
FIG. 4 is a view showing a relationship between a high molecular weight peak in a binder resin and heat resistance.
Figure 5:
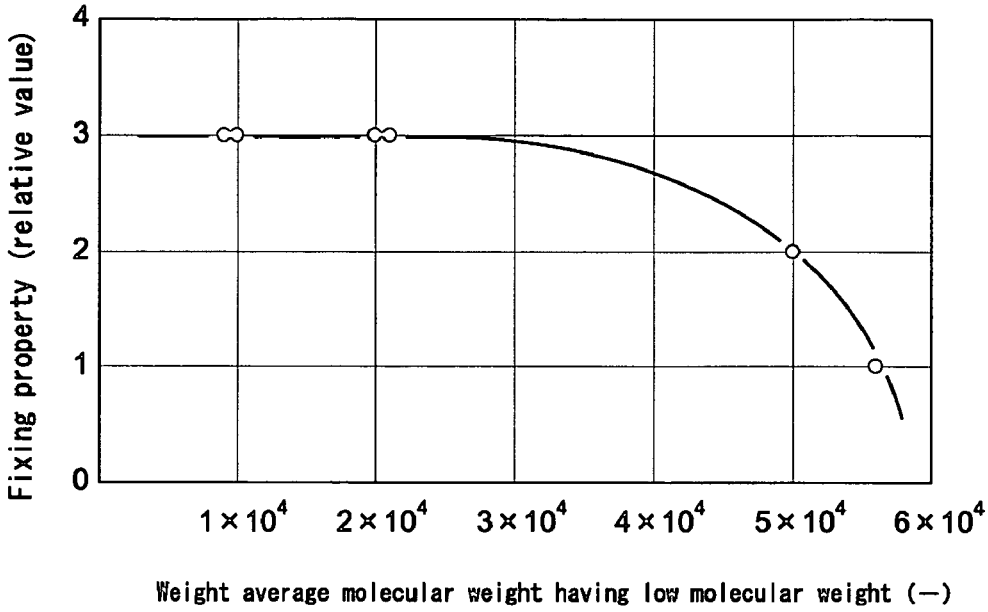
FIG. 5 is a view showing a relationship between a low molecular weight peak in a binder resin and fixing property.

Here, as general property of the binder resin which has two molecular weight peaks in the developer, the relationship between the high molecular weight peak and heat resistance is shown in FIG. 4, and the relationship between low molecular weight peak and fixing resistance is shown in FIG. 5.

FIG. 4 shows a characteristic curve, wherein the weight average molecular weight of the binder resin which has the high molecular weight peak is taken on an axis of abscissas and the heat resistance is taken on an axis of ordinates. Further, FIG. 5 shows a characteristic curve, wherein the weight average molecular weight of the binder resin which has the low molecular weight peak is taken on an axis of abscissas and the fixing property is taken on an axis of ordinates.

As can be understood from the characteristic curve shown in FIG. 4 and FIG. 5, by containing the high molecular weight peak more than the predetermined value, it becomes possible to exhibit the high heat property. Further, by containing the low molecular weight peak less than the predetermined value, it becomes possible to exhibit the high fixing property. Accordingly, by using a plurality of binder resins which have different molecular weight peaks in a mixed state, it is possible to propose the developer which has excellent heat resistance and excellent fixing property.

Here, such a molecular weight of the binder resin can be obtained by measuring an elution time of the binder resin from a column by using a molecular weight measuring device (GPC) and, thereafter, by collating the elution time with a calibration curve which is preliminarily formed by using a standard polystyrene resin.

Further, it is preferable that the glass transition point (Tg) of the binder resin is arranged at the value which falls with in a predetermined range. Here, in case of the binder resin according to the embodiment, it is preferable that the glass transition point (Tg) is set to the value which falls within a range from 51 to 55° C.

The reason is that when the glass transition point of the binder resin is set to a value of below 51° C., there is a possibility that the obtained toners are melted to each other thus lowering the preservation stability, while when the glass transition point of the binder resin exceeds 55° C., there is a possibility that the fixing property of the toner becomes lowered.

Figure 6:
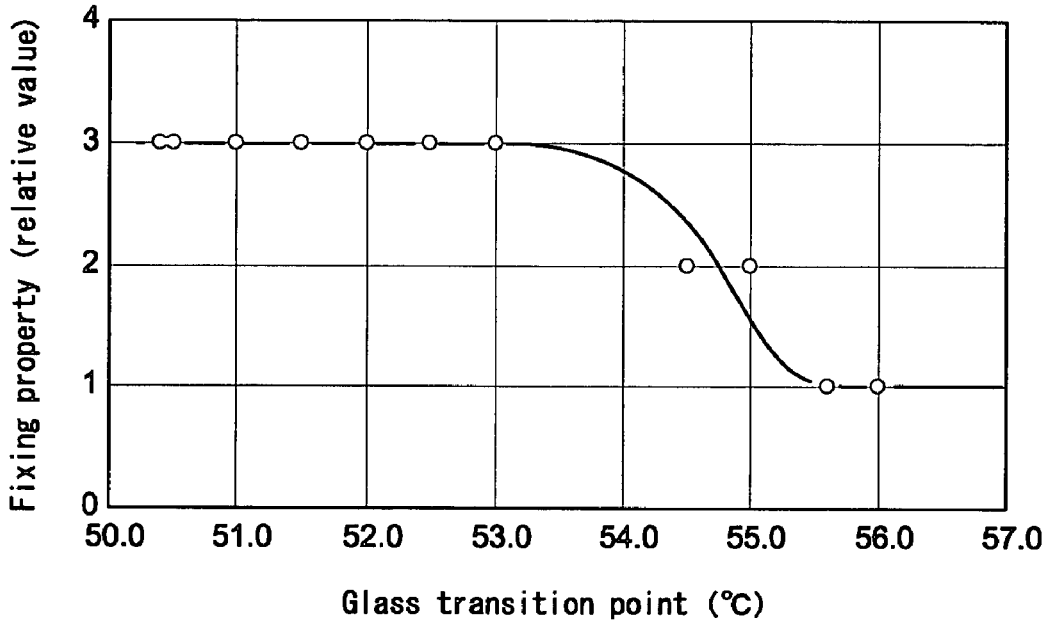
FIG. 6 is a view showing a relationship between a glass transition point and fixing property in a binder resin.

Here, in general, the relationship between the glass transition point (Tg) and fixing property of the toner of the binder resin is shown in FIG. 6. As can be understood from the characteristic curve shown in FIG. 6, by controlling the glass transition point (Tg) to the value which falls with in a predetermined range, it is possible to obtain the excellent fixing property.

Here, these glass transition points of the binder resin can be obtained based on a changing point of a specific heat by using a differential scanning calorimeter (DSC).

(1)-3 Softening Point

Further, it is preferable that the binder resin contains a plurality of binder resins. Here, the softening point of the first binder resin is set to a value of below 120° C. and, at the same time, the softening point of the second binder resin is set to 120° C. or more, for example.

The reason is that even when the temperature is set to a fixing temperature of approximately 150° C., excellent fixing property can be obtained and, at the same time, heat resistance and dispersibility are improved and hence, in a high-speed image forming apparatus having a developing unit which possesses a spiral member, even when the printing is performed continuously under a high temperature and high moisture condition, it may be possible to effectively prevent drawbacks such as the aggregation of toner caused by the temperature elevation of a machine or a developing unit.

Accordingly, it is more preferable that the softening point of the first binder resin is set to a value of below 115° C. and, at the same time, the softening point of the second binder resin is set to 125° C. or more.

Further, as a measuring method of the softening point, for example, a following method which uses a flow tester may be named.

First of all, approximately 1.5 g of toner particles passing sieve of 60 mesh (250 μm of opening) is weighed and, thereafter, the toner particles are pressurized with a load of 100 kg/cm$^2$ (9800 kPa) for one minute by using a molder.

Next, by using a flow tester CFT-500D (made by Shimadzu Corporation), a load of 10 Kgf (98N) is applied to the sample, a plunger descending quantity is measured by a temperature elevating method (temperature elevation: 4.0° C./min, die diameter: 1.0 mm, die length: 1.0 mm), and a fluidity curve is obtained thus measuring the softening point.

(1)-4 Acid Value

Further, it is preferable that the binder resin contains a plurality of polyester resins. Here, the acid value of the first polyester resin is set to a value of below 6 mgKOH/g and, at the same time, the acid value of the second polyester resin is set to 6 mgKOH/g or more.

The reason is that by setting the acid value of the first polyester resin to such a value, not only compatibility between the first polyester resin and the second polyester resin is improved but also excellent fixing property can be obtained and, at the same time, heat resistance is improved. Accordingly, in a high-speed image forming apparatus having a developing unit which possesses a spiral member or the like, even when the printing is performed continuously under a high temperature and high moisture condition, it may be possible to effectively prevent drawbacks such as the aggregation of the toner caused by the temperature elevation of a machine or a developing unit.

Accordingly, as a range of the acid value, it may be preferable to set the acid value of the first polyester resin to a value which falls within a range from 0 to 5.0 mgKOH/g, and it is more preferable that the acid value is set to a value which falls within a range from 0.1 to 4.0 mgKOH/g. On the other hand, it may be preferable to set the acid value of the second polyester resin to a value which falls within a range from 6 to 30 mgKOH/g, and it is more preferable that the acid value is set to a value which falls within a range from 7 to 20 mgKOH/g. Here, the acid values which are defined in the present invention are values obtained by a neutralization titration method which uses KOH, wherein the acid value is defined as the mg number of KOH which is necessary for neutralizing 1.0 g of fats and oils.

(1)-5 Addition Quantity

Further, it may be preferable to set an addition quantity of the binder resin to a value which falls within a range from 45 to 65 weight % with respect to a total quantity of the developer.

The reason is that, when the addition quantity of the binder resin is below 45 weight %, there may arise a case in which the obtained toners are melted with each other and preservation stability is lowered, while when the addition quantity of the binder resin exceeds 65 weight %, there may arise a case in which fixing property of the toner is lowered.

Accordingly, it may be preferable to set the addition quantity of the binder resin to a value which falls within a range from 45 to 65 weight % with respect to the total quantity of the developer.

(2) Waxes

Further, since the toner is required to satisfy several advantageous effects such as fixing property and offset property, it may be preferable to add waxes to the toner.

Although a kind of wax is not specifically limited, one kind of or the combination of two or more kinds of the wax selected from a group consisting of a polyethylene wax, a polypropylene wax, a fluororesin wax, a Fischer Tropsch wax, a paraffin wax, an ester wax, a montan wax, a rice wax and the like may be named for example.

Here, it may be preferable to set the addition quantity of the wax to a value which falls within a range from 1 to 15 weight % with respect to the total quantity of the developer.

(3) Charge Controlling Agent

Further, from a viewpoint of remarkably enhancing a charge level or a charge rise characteristic (an index which indicates whether the toner is charged to a predetermined charge level or not in a short period) so as to obtain excellent durability, stability or the like, it may be preferable to add a charge controlling agent to the toner.

Although a type of such a charge controlling agent is not specifically limited, it may be preferable to use the charge controlling agent which shows positive charging property such as, a Nigrosine, a quaternary ammonium salt compound, a resin-type charge controlling agent in which an amine compound is combined with a resin or the like, for example.

Here, it may be preferable to set the addition quantity of the charge controlling agent to a value which falls within a range from 1.5 to 15 weight % with respect to the total quantity of the developer.

(4) Magnetic Powder

Further, the toner can be formed into a magnetic toner by dispersing a known magnetic powder into the toner.

As preferred magnetic powder, metal powder or alloy powder which exhibits ferromagnetism such as ferrite powder, magnetite powder, iron powder, cobalt powder, nickel powder or a compound powder which contains these ferromagnetic powders can be named. Further, as the preferred magnetic powder, it is also possible to name alloy powder which does not contain ferromagnetic elements but exhibits ferromagnetism when proper heat treatment is applied to the alloy powder.

Further, it may be preferable to apply surface treatment to the magnetic powder by using a surface treatment agent such as a titanium-based coupling agent or a silane-based coupling agent. The reason is that, by carrying out the surface treatment in this manner, it may be possible to improve hygroscopic property of the magnetic powder and the dispersion property of the magnetic powder.

Here, it is preferable to set an addition quantity of magnetic powder to a value which falls within a range from 30 to 50 weight % with respect to a total quantity of the developer.

(5) Additive Agent

Further, when hydrophobic silica is used as an additive agent, it is preferable to set an addition quantity thereof to a value which falls within a range from 0.5 to 2.0 weight % with respect to a total quantity of the toner.

The reason is that when the addition quantity of the hydrophobic silica is set to a value which falls within a predetermined range, it is possible to obtain predetermined stress resistance and, at the same time, it is possible to hold stable photoreceptor polishing ability, while it is possible to effectively prevent a charge-up. Further, it is also possible to effectively prevent a drawback that an image density is lowered under a low temperature and low moisture condition.

Figure 7:
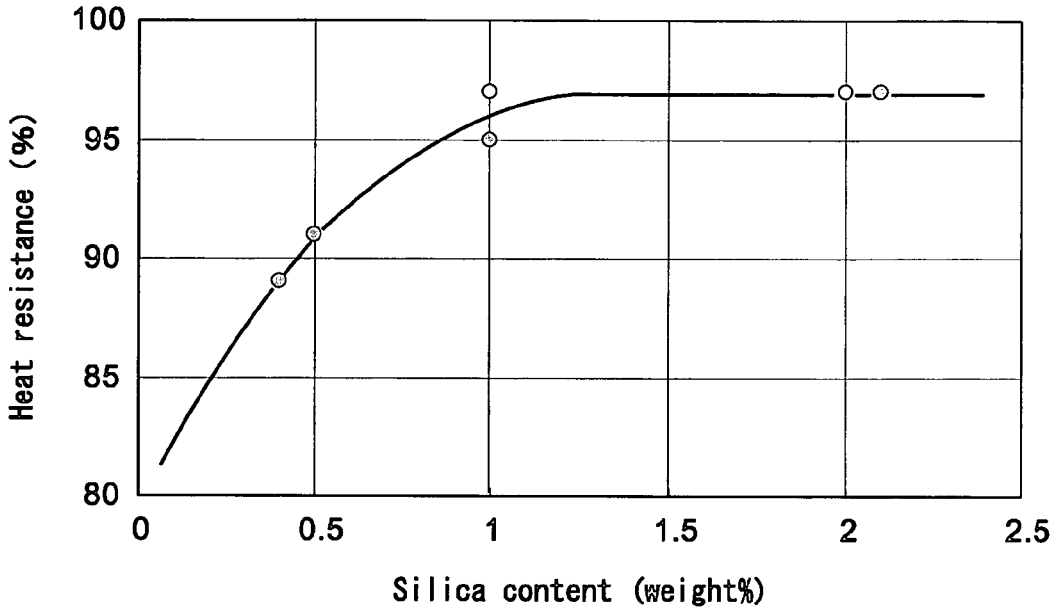
FIG. 7 is a view showing a relationship between a silica content in a binder resin and heat resistance.

Here, as a general characteristic of the additive agent, a relationship between the addition quantity of the hydrophobic silica and heat resistance is shown in FIG. 7.

As can be understood from a characteristic curve shown in FIG. 7, by respectively controlling the addition quantity of hydrophobic silica to respective values which fall within predetermined ranges, it is possible to stably hold both of fixing property and heat resistance.

2. Average Particle Size

Further, the developer which is used in the present invention is characterized in that an average particle size of the toner particles is set to a value which falls within a range from 6 to 9 μm.

The reason is that when the average particle size of the toner particles is set to a value of below 6 μm, fluidity of the toner particles is lowered and the toner particles are liable to be adhered to the spiral member and hence, it is difficult to scrape off the toner particles from the spiral member. Further, when such toner particles are continuously used for a long time, the supply of the toner particles to the developer carrying body becomes insufficient and hence, it is difficult to hold an image density.

On the other hand, when the average particle size of the toner particles is set to a value of above 9 μm, although fluidity is enhanced, it is difficult to uniformly apply a proper charge to the toner particles. Further, it is difficult to faithfully reproduce a latent image such as a fine line or the like thus lowering the image quality.

Accordingly, it is preferable to set an average particle size to a value which falls within a range from 6.5 to 8.5 μm, and it is more preferable to set the average particle size to a value which falls within a range from 7.0 to 8.0 μm.

Further, in the developer which is used in the present invention, it is preferable to set a content of toner particles having a particle size of below 5 μm to a value of below 20 volume % with respect to the total quantity of the toner particles.

The reason is that, by controlling the content of the toner particles having an average particle size of below a predetermined value, it is possible to control the content of finer particles which can not be sufficiently controlled only with the control of a value of the average particle size and hence, it is possible to produce the developer which exhibits the more excellent fluidity.

However, when the content of the toner particles having the particle size of below 5 μm is excessively decreased, the distribution of the particle size of the toner particles is becomes non-uniform thus also giving rise to a possibility that the fluidity is lowered.

Accordingly, it is preferable to set the content of the toner particles having a particle size of below 5 μm to a value which falls within a range from 0.1 to 20 volume %, and it is more preferable that the content of the toner particles having a particle size of below 5 μm to a value which falls within a range from 5 to 15 volume %.

3. Average Degree of Circularity

Further, the developer which is used in the present invention is characterized in that an average degree of circularity of the toner particles is set to a value which falls within a range from 0.950 to 0.960.

The reason is that when the average degree of circularity is set to a value of below 0.950, the fluidity of the toner particles is lowered and the toner particles are liable to be adhered to the spiral member and hence, it is difficult to scrape off the toner particles from the spiral member by using a toner removing member.

Further, another reason is that when such toner particles are continuously used for a long time, the supply of the toner particles to the developer carrying body becomes insufficient and hence, it is difficult to hold the image density.

Still another reason is that in such toner particles, stress between the toner particles is large and hence, the aggregated toner is liable to be generated in the inside of the developing unit thus giving rise to a drawback that stripes are generated on the developing sleeve.

On the other hand, when the average degree of circularity exceeds 0.960, the fluidity of the toner particles is improved and hence, it is possible to easily hold the image density.

However, in such toner particles having the average degree of circularity of above 0.960, there may arise a drawback that adjustment of charging becomes difficult. For example, in the developing unit which uses a metal material such as stainless steel or the like as a material of the sleeve, a charge imparting force of the sleeve is strong and hence, toners existing in the vicinity of the sleeve surface have an extremely very high charge and hence, the toners are strongly attracted to the surface of the sleeve by a reflection force whereby an immobile layer may be easily formed. Accordingly, a frictional chance between the toner particles and the sleeve is decreased and hence, the imparting of charge is interrupted, Due to the non-uniform charging of the toner, the irregularities or "mura" on a toner thin layer which is formed on the developing sleeve thus giving rise to a possibility that the thin layer irregularities are generated.

Accordingly, it is preferable to set such an average degree of circularity to a value which falls within a range from 0.952 to 0.958, and more preferably, within a range from 0.954 to 0.956.

Further, the developer used in the present invention is characterized in that the content of toner particles whose degree of circularity is below 0.850 is set to a value which falls within a range from 2.0 to 4.0 unit % with respect to the total quantity of the toner particles. That is, this implies that the toner whose degree of circularity is below 0.850 and slightly contains toner particles whose shape is remote from a true spherical shape.

Here, influence which the content of toner particles having the degree of circularity of below 0.850 asserts on an image density and the like is explained in conjunction with FIG. 8 and FIG. 9.

Figure 8:
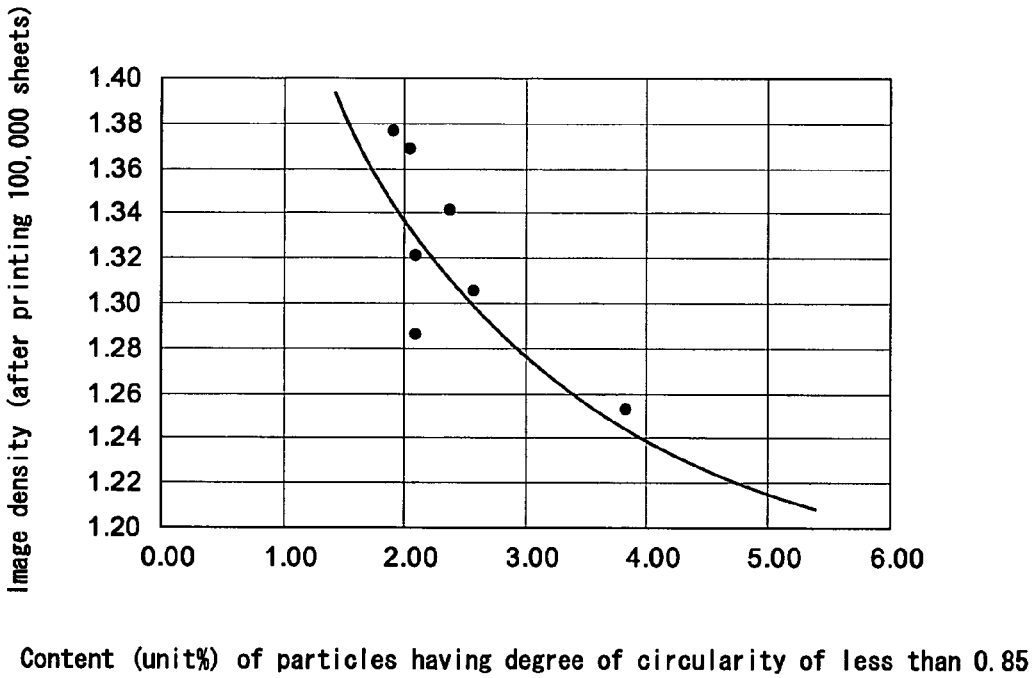
FIG. 8 is a view showing a relationship between a content of particles having a degree of circularity of below 0.85 and the density of an image.

FIG. 8 is a characteristic curve, wherein the content (unit %) of toner particles having the degree of circularity of below 0.850 is taken on an axis of abscissas, and the image density which is evaluated by a method described in the embodiment 1 after continuously printing 100,000 sheets under a high temperature and high moisture environment (32° C., 80% RH) is taken on an axis of ordinates.

As can be understood from the characteristic curve, the larger the content of toner particles having the degree of circularity of below 0.85, the image density is lowered. Particularly, it is safe to say that when the content of toner particles exceeds 4.0 unit %, the image density is remarkably decreased. This is because that the toner particles contains a large quantity of particles having shapes remote from a true spherical shape and hence, a contact area between the toner particles and the photoreceptor is enlarged whereby an adhesive force of the toner particles to the photoreceptor is increased. Accordingly, it is impossible to obtain the sufficient toner transfer efficiency in a succeeding transfer step and hence, the image density cannot be held.

Further, such toner particles exhibit the non-uniform degree of circularity, even when a toner removing member which removes toner adhered to the spiral is provided to the above-mentioned developing unit, the toner is liable to be easily deteriorated due to a friction between the spiral and the toner removing member and hence, the fluidity of the toner is also lowered. Accordingly, such a toner may adversely influence the agitation and carrying property of the toner thus easily generating stripes on a thin layer of the sleeve. This phenomenon is particularly liable to take place under a high temperature environment.

Figure 9:
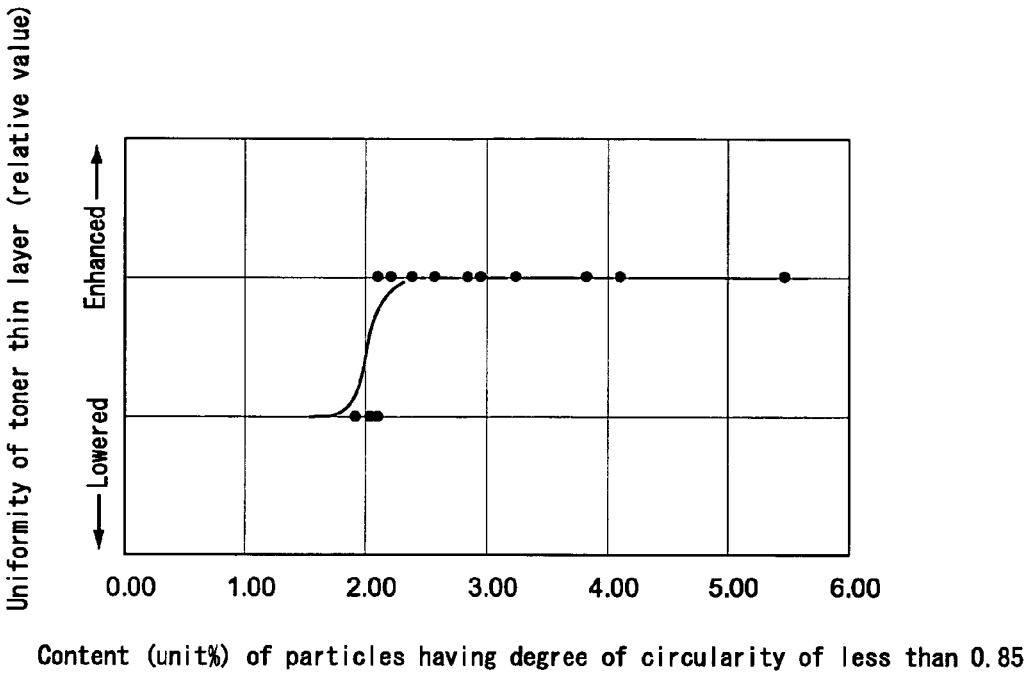
FIG. 9 is a view showing a relationship between a content of particles having a degree of circularity of below 0.85 and the thin layer irregularities.

Further, FIG. 9 shows a characteristic curve, wherein the content (unit %) of toner particles having the degree of circularity of below 0.850 is taken on an axis of abscissas, and a result of the observation of the developing sleeve on which a thin layer is formed with naked eyes after continuously printing 100,000 sheets under a low temperature and low moisture environment (10° C., 15% RH) is taken on an axis of ordinates.

Further, the uniformity of the toner thin layer taken on the axis of ordinates serves to evaluate the state of the toner layer in three stages, wherein corresponding to the formation of an improved toner thin layer which exhibits the smaller irregular generating quantity, the uniformity of the toner thin layer assumes a higher value.

As can be understood from such a characteristic curve, when the content of toner particles having the degree of circularity of below 0.85 becomes approximately 2.0 unit % or less, the thin layer irregularities are liable to be generated. This is because that the degree of circularity of toner particles is excessively uniform and hence, the toner particles tend to be arranged extremely close to each other thus easily generating the aggregation (soft blocking) resulting in the formation of aggregated bodies which are blocks made of toner particles.

Further, when the degree of circularity of the toner particles is increased as a whole, a charge quantity is liable to be increased correspondingly. In such a case, the adjustment of charging becomes difficult. Accordingly, in the same manner as the case in which the degree of average circularity exceeds 0.960, a charge imparting force of the sleeve is increased and hence, the toner particles which are present in the vicinity of a surface of the sleeve have an extremely high charge whereby the toners are strongly attracted to the surface of the sleeve by a reflection force thus forming an immobile layer.

Accordingly, a friction chance between the toner particles and the sleeve is decreased and hence, the imparting of charge is interrupted. As a result, the toner thin layer which is formed on the developing sleeve is disturbed by the non-uniform charging of the toner. Particularly, thin layer irregularities are liable to be easily generated under a low temperature environment.

In view of the above, it is preferable to set the content of toner particles having the degree of circularity of below 0.85 to a value which falls within a range from 2.2 to 3.8 (unit %) and it is more preferable to set the value to fall within a range from 2.5 to 3.5 (unit %).

Figure 10:
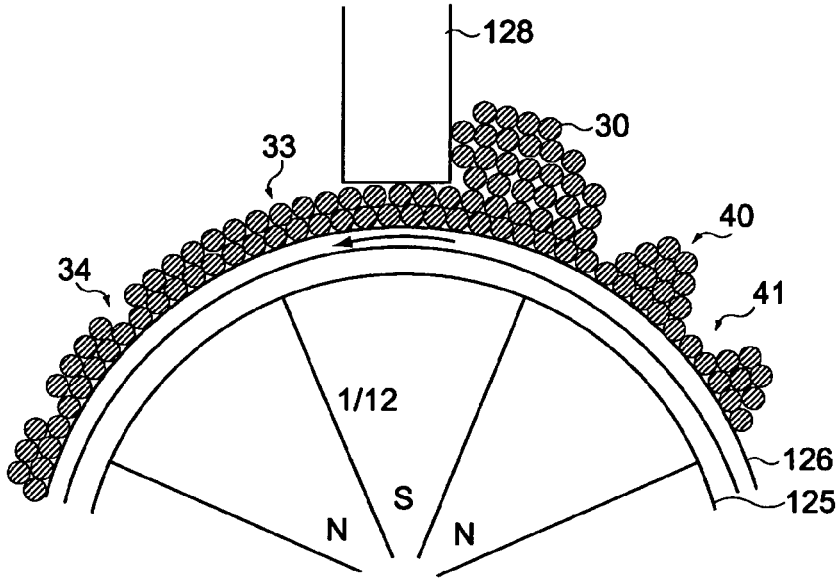
FIG. 10(*a*) to (*b*) are schematic perspective views for explaining a step in which the thin layer irregularities are formed.
Figure 10:
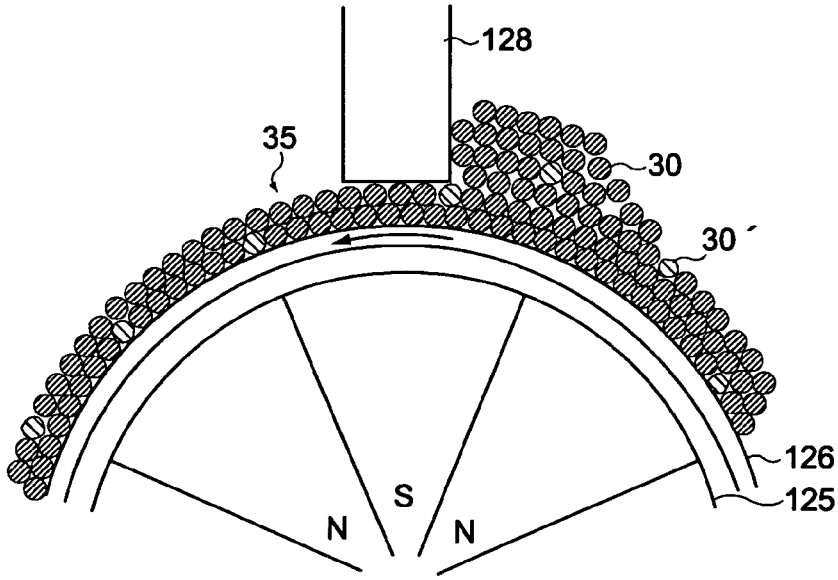

Further, a phenomenon that the aggregation property of the toner can be improved when the toner contains a predetermined quantity of toner particles having low degree of circularity is schematically explained in conjunction with FIG. 10(*a*) and FIG. 10(*b*).

FIG. 10(*a*) is a cross-sectional schematic view showing a state in which a toner thin layer is formed with the content of the toner particles having the degree of circularity of below 0.85 set to a value close to 0 unit %.

As shown in FIG. 10(*a*), when the toner particles 30 having the high degree of circularity as a whole is used, due to the above-mentioned reason, aggregated bodies 40 which are blocks of toner particles are partially formed on the developing sleeve 126.

Figure 11:
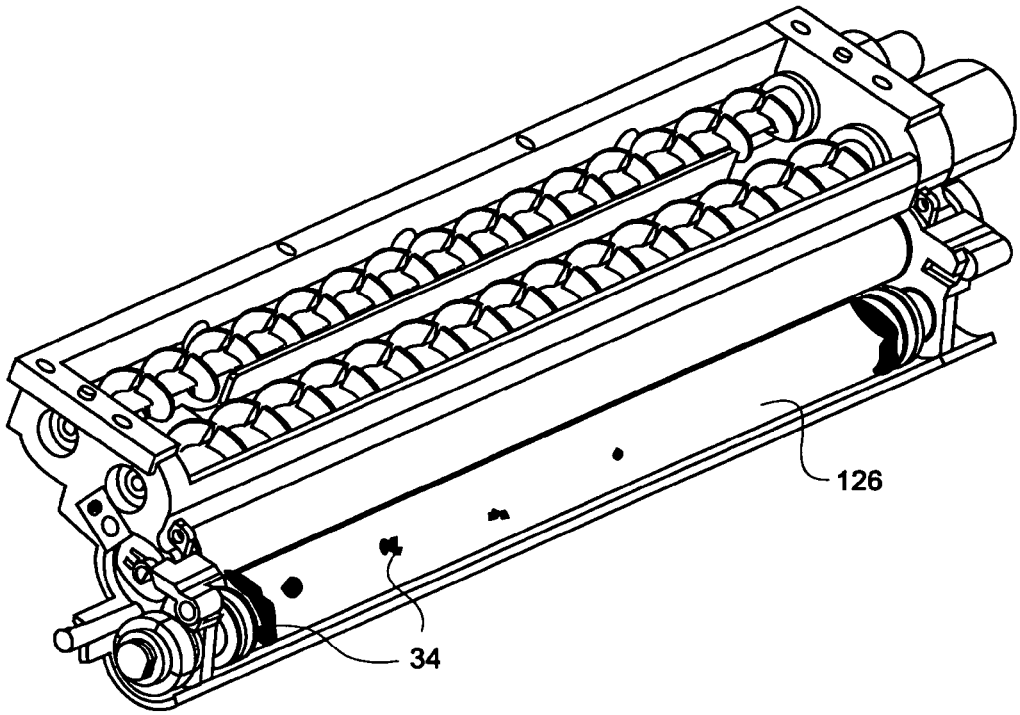
FIG. 11 is a schematic perspective view of the thin layer irregularities formed on a developing sleeve.
Figure 12:
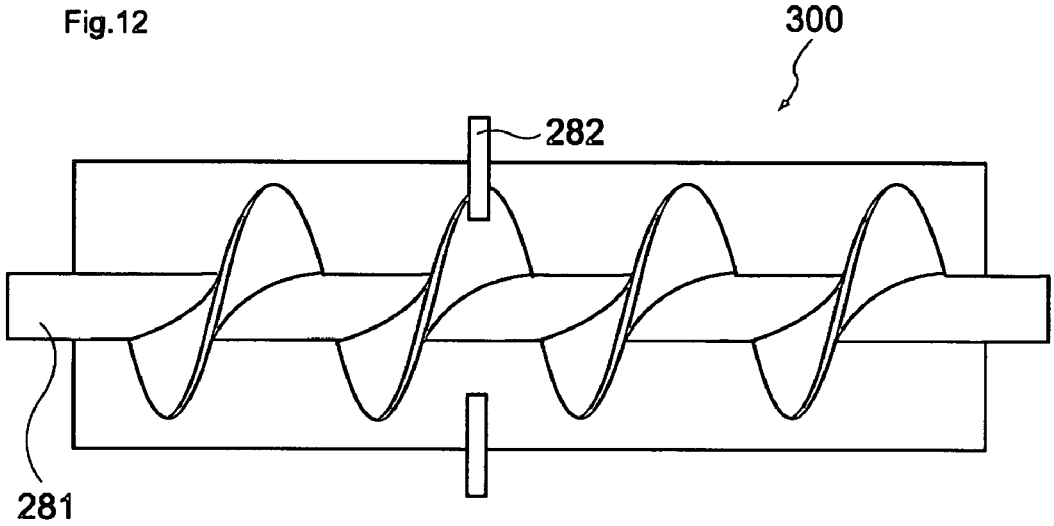
FIG. 12 is a view showing the constitution of a conventional developing unit.

When the aggregated bodies 40 which are formed in this manner are spotted on the developing sleeve 126, thin film regions 41 which have a small thickness are locally formed in gaps between the aggregated bodies 40. When the thickness of the thin film regions 41 is smaller than a gap width between a layer thickness restricting member 128 and the developing sleeve 126, after the layer thickness restricting member passes, the layer thickness irregularities 34 are generated. Further, when such aggregated bodies 40 are formed over a certain degree of region, as shown in FIG. 11, the thin film irregularities 34 are observed over a broad range.

On the other hand, FIG. 10(*b*) is a cross-sectional schematic view showing a state in which a toner thin layer is formed when the content of the toner particles having the degree of circularity of below 0.85 is set to approximately 2.0 to 4.0 (unit %).

As shown in FIG. 10(*b*), when the toner particles containing toner particles 30' which has the low degree of circularity are used, due to the presence of the toner particles 30', the close contact between the particles is properly lowered thus impeding the formation of the aggregated bodies 40.

As a result, the above-mentioned thin film regions 41 are not formed and hence, the toner thin layer 35 which exhibits the excellent layer thickness uniformity can be formed 4. Manufacturing Method Next, the manufacturing method of the developer according to the present invention is explained.

First of all, the above-mentioned binder resin, the waxes, the charge controlling agent, the magnetic powder and the waxes are premixed using a known method and thereafter, are melted and kneaded to prepare the resin composition for toner.

Here, it is preferable to perform the premixing treatment using, for example, a Henschel mixer, a ball mill, a super mixer, a dray blender or the like, while it is preferable to perform the melting and kneading treatment using a twin-screw extruder, a one-screw extruder or the like.

Next, the obtained resin composition for toner is pulverized using a known method and, thereafter, the fine-power classifying is performed to produce the toner particles.

Here, it is preferable to perform the pulverizing treatment using an airflow type pulverizer, for example, while it is preferable to perform the classifying treatment by using an air classifying machine or the like, for example.

The reason is that by forming and molding such a pulverizing method, it is possible to control the average particle size and the average degree of circularity prescribed in the present invention to values which respectively fall within predetermined ranges. Further, it is also possible to accurately control parameters which are difficult to control such as the content of the toner particles having the average degree of circularity of below 0.85 and the content of the toner particles having the particle size of 5 μm or less.

The toner which is obtained in this manner is mixed together with the additive agents in a known method thus forming the toner which contains the additive agents. As a method for adding the additive agents, the additive agents are mixed with the toner using a Henschel mixer.

5. Developing Unit

Further, as a developing unit which is used in the present invention, as shown in FIG. 1, it may be possible to use a developing unit 114 which includes a developing container 122 for accommodating the developer, a developer carrying body 127 for carrying the developer and conveying the developer to a developing region, a developer layer thickness restricting member 128 for restricting a layer thickness of the developer, spiral members 150 which are rotated with respect to predetermined rotation axes as centers of rotation and agitate and convey the developer in the rotation axis direction.

Here, the spiral members 150 are constituted of a first spiral member 123 and a second spiral member 124 which constitute conveying means for conveying the toner particles in a predetermined direction and a toner removing member 136 for removing the toner particles which are adhered to the spiral members 123, 124.

Figure 2:
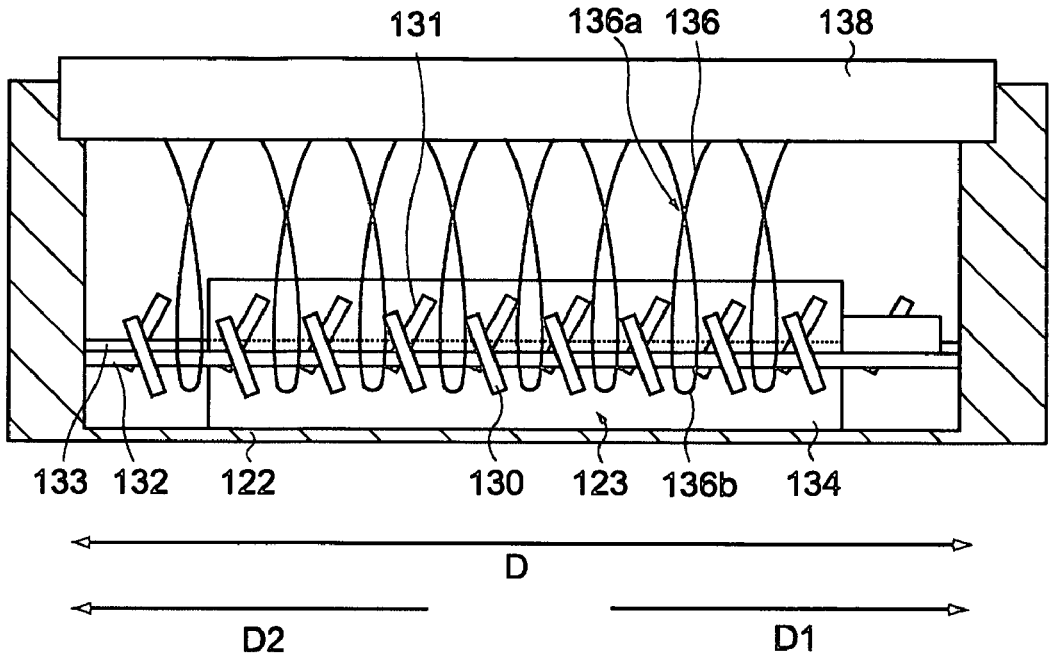
FIG. 2 is a view showing a spiral member and a toner removing member in a first embodiment.

To be more specific, as shown in FIG. 2, the spiral members 150 are provided with the first spiral member 123 which is formed of a rotatable shaft 132 which is arranged in the inside of an agitating chamber 140 for agitating the toner particles and spiral-like blades 130 which are mounted on a peripheral surface of the shaft 132, wherein by rotating the first spiral member 123 in the direction indicated by an arrow A in FIG. 1, the toner is conveyed in the longitudinal direction of the shaft 132 (direction indicated by an arrow D in FIG. 2).

Further, as shown in FIG. 2, the spiral member 150 is provided with the second spiral member 124 which is formed of a rotatable shaft 133 which is arranged substantially parallel to the shaft 132 and spiral-like blades 131 which are mounted on a peripheral surface of the shaft 133, wherein by rotating the second spiral member 124 in the direction indicated by an arrow B in FIG. 1, the toner is conveyed in the longitudinal direction of the shaft 133 (direction indicated by an arrow D in FIG. 2).

Here, the first spiral member 123 and the second spiral member 124 are arranged in approximately parallel to each other. Further, between the first spiral member 123 and the second spiral member 124, a partition member 134 which divides the agitating chamber 140 and the developing chamber 141 in a state that the agitating chamber 140 and the developing chamber 141 are communicable with each other is provided. Accordingly, it may be possible to convey the toner while agitating the toner in a circulating manner.

Further, as shown in FIG. 1, the developing unit includes a fixing magnet roller 125 which is arranged on a drum opening side of the developing container 122 and has a plurality of magnetic poles, and the developer carrying body 127 which includes a non-magnetic developing sleeve 126 which accommodates the fixed magnet roller 125 in the inside thereof and is pivotally and rotatably supported for introducing the accommodated toner to the surface of the photoreceptor 111.

Further, the developing unit includes a developer layer thickness restricting member 128 which is formed of a plate-like magnetic body and is arranged in the vicinity of the developing sleeve 126 and extends downwardly toward an upper surface of the developing sleeve 126 and a magnetic body sealing member 129 which is arranged at an end portion of the developing sleeve 126 in the longitudinal direction.

Further, a toner replenishing hole (not shown in the drawing) is opened above the first spiral member 123 so as to allow the supply of the toner therethrough. That is, the supplied toner is carried in the inside of the agitating chamber 140 by using the first spiral member 123 while being agitated from the left end in FIG. 2 in the right direction, that is, in the direction indicated by an arrow D1 in the drawing with respect to the longitudinal directions D of the shaft 132 and is introduced into the developing chamber 141. The toner which is introduced into the developing chamber 141 is conveyed while being agitated in the inside of the developing chamber 141 by the second spiral member 124 in the left direction from the right end in FIG. 2, that is, in the direction indicated by an arrow D2 in the drawing with respect to the longitudinal directions D of the shaft 132 and is introduced into the developing sleeve 126. The toner which is introduced into the developing sleeve 126 is carried on the developing sleeve 126 by making use of a magnetic force of the fixed magnet roller 125 and, a thickness of the toner is restricted by the developer layer thickness restricting member 128 which is arranged in the vicinity of the developing sleeve 126.

Thereafter, the toner which is carried on the developing sleeve 126 is guided to a developing position, that is, a surface of the photoreceptor 111 by the developer carrying body 127 and, due to a contact between the photoreceptor 111 and a printing paper, an image is transferred and formed on the printing paper.

Further, as shown in FIG. 1, on the first spiral member 123 and the second spiral member 124, toner removing members 136, 137 for removing the toner adhered to the spiral members 123, 124 are mounted.

To be more specific, the toner removing member 136 is arranged in a state that at least a portion of the toner removing member 136 is brought into contact with a surface of the first spiral member 123 in the inside of the developing container 122 and is supported on a supporting member 138 which is mounted in the inside of the container 122. Further, in the same manner, the toner removing member 137 is arranged in a state that at least a portion of the toner removing member 137 is brought into contact with a surface of the second spiral member 124 in the inside of the developing container 122 and is supported on a supporting member 138 which is mounted in the inside of the developing container 122.

Here, the toner removing members 136, 137 may be formed of a metal wire having a predetermined elastic modulus by taking a toner removing effect and durability into consideration.

Further, as shown in FIG. 2, the toner removing portion 136 includes a twisted portion 136*a*, wherein the twisted portion 136*a* is formed in a state that a cross-sectional shape of a portion 136*b* (hereinafter, referred to as "toner scraping portion 136*b*") which is brought into contact with the surface of the first spiral member 123 in the direction (the directions indicated by arrows Y1, Y2 in FIG. 1) orthogonal to the longitudinal direction D of the shaft 132 of the first spiral member 123 has an approximately elliptical shape.

Here, although only the toner removing member 136 is shown in FIG. 2, the toner removing member 137 also has the same shape as the toner removing member 136. That is, a twisted portion (not shown in the drawing) is formed on the toner removing member 137 and is formed in a state that a cross-sectional shape of a portion of the toner removing member 137 which is brought into contact with the surface of the second spiral member 124 in the direction (the directions indicated by arrows Z1, Z2 in FIG. 1) which intersects the longitudinal direction D of the shaft 133 of the second spiral member 124 at a right angle exhibits an approximately elliptical shape.

That is, in a process of conveying the developer from the developing container 122 to the photoreceptor 111, the developer receives a dynamic stress when the developer is brought into contact with the spiral member and the toner removing member. For example, even when stress is continuously applied to the developer by the spiral member and the toner removing member under a high temperature environment where a temperature is 30° C. or more, it may be possible to effectively prevent the generation of drawbacks such as aggregation or image vertical stripes.

Second Embodiment

The second embodiment is directed to an image forming method which is characterized in that the developer of the present invention is used in a developing unit which includes an agitating and conveying means for conveying the toner particles in the direction of the rotary shaft.

Hereinafter, the constitutions of the present invention which are explained already in conjunction with the first embodiment are omitted and the explanation is made by focusing on points which make the second embodiment different from the first embodiment.

1. Image Forming Apparatus

Figure 3:
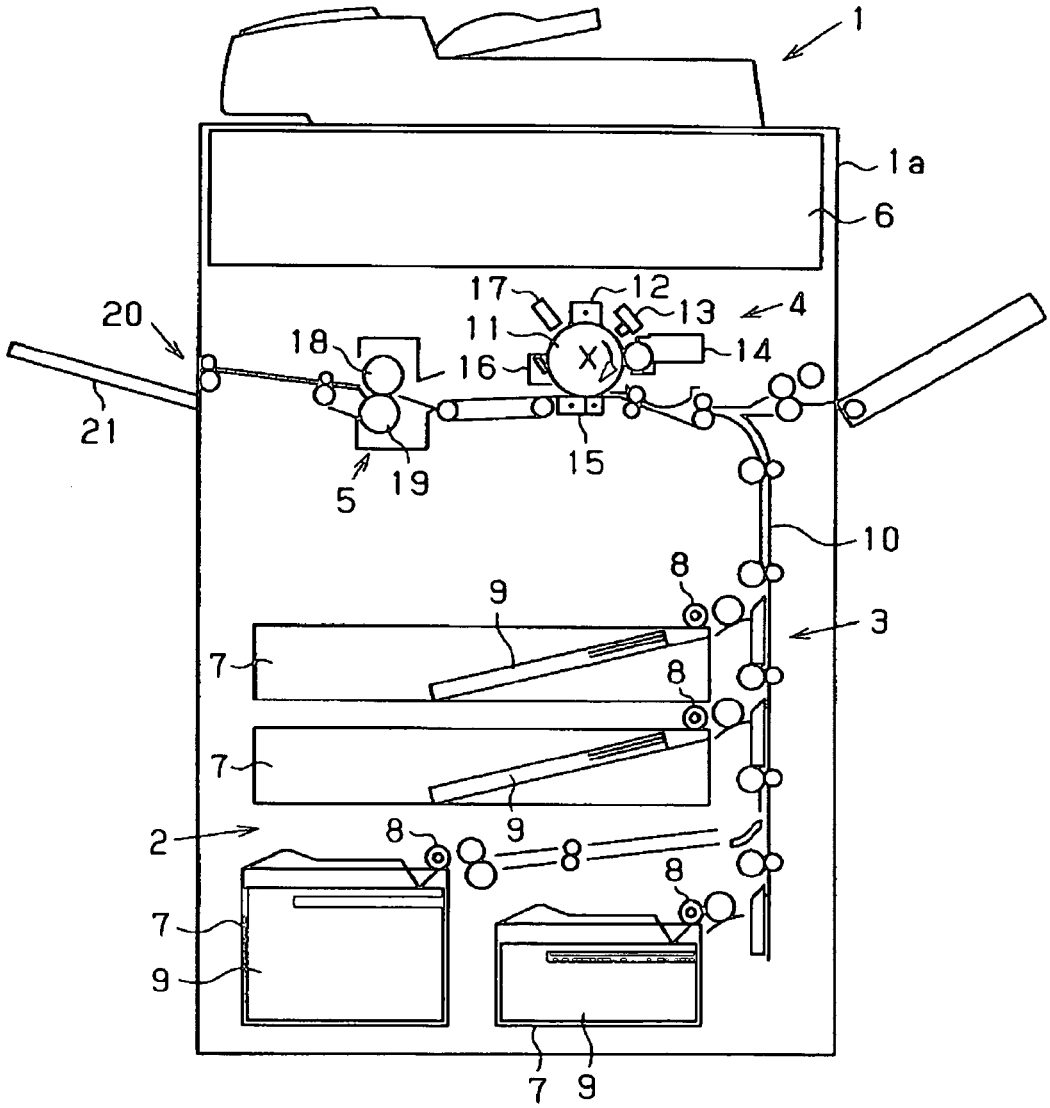
FIG. 3 is a view for explaining an image forming method in a second embodiment.

In performing the image forming method according to the second embodiment, it may be possible to favorably apply the image forming method to an image forming apparatus 1 shown in FIG. 3.

Here, FIG. 3 is a schematic view showing the whole constitution of the image forming apparatus. The image forming apparatus 1 includes a paper feeding part 2 which is arranged in a lower portion of the image forming apparatus body 1*a*, a paper conveying part 3 which is arranged on a side of and above the paper feeding part 2, an image forming part 4 which is arranged above the paper conveying part 3, a fixing part 5 which is arranged at a position closer to a discharge side than the image forming part 4, and an image reading part 6 which is arranged above the image forming part 4 and the fixing part 5.

Further, the paper feeding part 2 includes a plurality of (four in the embodiment) paper feeding cassettes 7 which store papers 9. Due to a rotational operation of a paper feeding roller 8, the papers 9 are fed to the paper conveying part 3 side from the paper feeding cassette 7 which is selected from the plurality of paper feeding cassettes 7 so as to surely feed the papers 9 one by one to the paper conveying part 3. Here, these four paper feeding cassettes 7 are detachably mounted on the image forming apparatus body 1*a*.

Further, the paper 9 which is fed to the paper conveying part 3 is conveyed toward the image forming part 4 via a paper feeding path 10. The image forming part 4 is provided for forming a predetermined toner image on the paper 9 using an electrophotographic process. The image forming part 4 includes a photoreceptor 11 which constitutes an image carrying body and is pivotally supported in a state that the photoreceptor 11 can be rotated in the predetermined direction (in the direction indicated by an arrow X in the drawing) and also includes a charging device 12, an exposure device 13, a developing unit 14, a transfer device 15, a cleaning device 16 and a charge elimination device 17 which are arranged in the periphery of the photoreceptor 11 and along the rotational direction of the photoreceptor 11.

Further, the charging device 12 includes charging wires to which a high voltage is applied. By applying a predetermined potential to a surface of the photoreceptor 11 by making use of corona discharge generated by the charging wires, the surface of the photoreceptor 11 is uniformly charged. Then, in the exposure device 13, light based on image data of an original which is read by the image reading part 6 is radiated to the photoreceptor 11. Accordingly, the surface potential of the surface of photoreceptor 11 is selectively attenuated and an electrostatic latent image is formed on the surface of the photoreceptor 11. Next, the toner is adhered to the electrostatic latent image by using the developing unit 14, the toner image is formed on the photoreceptor 11 and, thereafter, the toner image on the surface of the photoreceptor 11 is transferred to the paper 9 which is supplied between the photoreceptor 11 and the transfer device 15 using the transfer device 15.

Further, the paper 9 to which the toner image is transferred is conveyed toward the fixing part 5 from the image forming part 4. The fixing part 5 is arranged on a downstream side of the image forming part 4 in the paper conveying direction. The paper 9 to which the toner image is transferred in the image forming part 4 is sandwiched between a heating roller 18 and a pressing roller 19 which is brought into pressure contact with the heating roller 18 which are provided in the fixing part 5, wherein the paper 9 is also heated by the heating roller 18 whereby the toner image is fixed to the paper 9. Next, the paper 9 on which the image is formed through steps of the image forming part 4 and the fixing part 5 is discharged to a discharge tray 21 by a pair of discharge rollers 20.

On the other hand, the toner remaining on the surface of the photoreceptor 11 is removed using a cleaning device 16. Here, a residual charge on the surface of the photoreceptor 11 is removed using a charge elimination device 17 and the photoreceptor 11 is charged again using the charging device 12. The image is formed by repeating the same steps hereinafter. Here, with the use of the magnetic monocomponent developing toner which satisfies predetermined conditions with respect to the developing unit which includes a spiral member as an agitating conveying means, stress resistance of toner particles is enhanced. Accordingly, even when the use environment is changed, there is no possibility that the toner aggregates and it may be possible to allow the toner to possess excellent fluidity. Accordingly, even in an environment in which the toner is easily influenced by stress, it may be possible to obtain excellent aggregation resistance and heat resistance while assuring a balance between these properties and the fixing property.

2. Magnetic Monocomponent Developer

The magnetic monocomponent developer which is used in a second embodiment may be set equal to the details of the magnetic monocomponent developer explained in conjunction with the first embodiment.

EXAMPLE

Hereinafter, the present invention is further explained in detail in conjunction with the examples. Here, it is needless to say that the following explanation of the present invention is provided only for an illustration purpose and the scope of the present invention is not limited to the following explanation without unless otherwise specified.

EXAMPLE 1

1. Formation of Toner (1) Formation of Toner Particles

A plurality of polyester resins is used as a binder resin and, at the same time, magnetic powder or the like is mixed into the binder resin and, thereafter, these resins are melted and mixed.

That is, first of all, polyester resins A and B are respectively formed. With respect to the polyester resin A, 2000 g of an additive agent with 2.2 mol of bisphenol-A propylene oxide, 800 g of an additive agent with 2.2 mol of bisphenol-A ethylene oxide, 500 g of terephthalic acid, 600 g of n-dodecenylsuccinic acid, 350 g of trimellitic acid anhydride and 4 g of dibutyl tin oxide are accommodated in a reaction vessel and, thereafter, these components are subjected to a condensation reaction at a temperature of 220° C. for 8 hours while being agitated in a nitrogen atmosphere. Thereafter, the condensation reaction is continued at a reduced pressure until a softening point reaches at 155° C.

Further, with respect to the polyester resin B, 2800g of an additive agent with 2.2 mol of bisphenol-A propylene oxide, 400 g of terephthalic acid, 650 g of fumaric acid and 4 g of dibutyltin oxide are accommodated in a reaction vessel and, thereafter, the components are subjected to a condensation reaction at a temperature of 220° C. for 8 hours while being agitated in a nitrogen atmosphere. Thereafter, the condensation reaction is continued at a reduced pressure until a softening point reaches at 90° C.

Then, 50 parts by weight of the polyester resin A (Tg: 60° C., a softening point: 150° C., an acid value: 7.0, a gel fraction: 30%) and 50 parts by weight of the polyester resin B (Tg: 60° C., a softening point: 150° C., an acid value: 7.0, a gel fraction: 30%), 10 parts by weight of an electrostatic charge controlling agent (styrene-acrylic quaternary ammonium salt), 5 parts by weight of the wax (carnauba wax Type 1 (made by S. Kato & Co.)), and 85 parts by weight of the magnetic powder 1 formed by the method described later are mixed by a Henschel mixer. Thereafter, these materials are melted and mixed by using a twin screw extruder thus forming a molten mixed material.

Next, after the molten mixed material is cooled, the cooled molten mixed material is pulverized by using a turbo mill (made by TURBO KOGYO CO., LTD.) which is a mechanical pulverizing apparatus until the volume average particle size becomes 11.0 μm. Further, the pulverized product is pulverized by using the pulverizing apparatus described above until the volume average particle size becomes 6.3 μm. Then, the pulverized material is classified into fine particles and course particles simultaneously by using an air classifier thus obtaining toner particles A which have a volume average particle size of 6.8 μm, contain 10.2 volume % of particles having a particle size of 5 μm or less and have an average degree of circularity of 0.955.

(2) Addition of Inorganic Particles

To 100 parts by weight of obtained toner particles, 0.8 parts by weight of hydrophobic silica (product name: RA200H, made by NIPPON AEROSIL CO., LTD.) is added and mixed by a Henschel mixer thus producing the toner A.

(3) Forming of Magnetic Powder

Next, a method of forming magnetic powder is described.

First of all, 60 liters of ferrous sulfate aqueous solution with the concentration of 1.8 mols/liter and 45 liters of sodium hydroxide aqueous solution with the concentration of 5 mols/liter are sufficiently agitated and mixed thus preparing ferrous hydroxide slurry.

Next, while holding the ferrous hydroxide slurry at a temperature of 80 to 90° C., an oxidative reaction is started by blowing air into the slurry at a rate of 20 liters/min. At a point of time that the oxidative reaction is progressed to cover 50% of entire $Fe^{2+}$, 10 liters of sodium hexametaphosphate solution with the concentration of 0.1 mol/liter is added to the ferrous hydroxide slurry including a magnetite which is in the process of oxidative reaction for 60 minutes. While holding the pHs of 6 to 9, the oxidative reaction is finished thus producing the magnetic powder 1.

Finally, upon finishing of the reaction, the slurry of the magnetic particles is cleaned, filtered and dried by a conventional method. Then, the particles which are slightly aggregated are crushed or pulverized and, thereafter, following magnetic properties are measured under a condition in which an external magnetic field is set to 79.6 kA/m by using a VSM-P7-type sample-vibration type magnetometer (made by Toei Industry Co., Ltd.).

Shape: Octahedron

Average particle size: 0.21 (μm)

Saturated magnetization (σs): 59.7 ($Am^2/kg$)

Residual magnetization (σr): 11.4 ($Am^2/kg$)

Coercive force (Hc): 11.1 (kA/m)

2. Evaluation of Toner

The volume average particle size and the degree of average circularity of the obtained toner A are measured. The obtained results are shown in Table 1. Specific evaluating methods with respect to respective items to be evaluated are as follows.

(1) Volume Average Particle Size

An electrolytic solution in which a measuring sample and a surface-active agent are suspended is adjusted and, thereafter, using this solution, the volume average particle size of the toner A is measured by using Multisizer II (made by Beckman Coulter, Inc.; aperture diameter: 100 μm).

(2) Degree of Average Circularity 10 ml of demineralized water from which solidified impurities or the like are preliminarily removed is prepared in a vessel, and a surface-active agent (alkyl benzene sulfonate) is added to the demineralized water as a dispersing agent. Thereafter, 0.02 g of a measuring sample is added and is uniformly dispersed thus adjusting a dispersing liquid. Next, using the dispersing liquid obtained in this manner, the degree of average circularity of the toner A is measured by using Flow-type particle image analyzer FPIA-2100 (made by SYSMEX CORPORATION).

That is, a particle projection image in the obtained dispersing liquid is obtained and, thereafter, a circumferential length (L1) and a projection area (S) of the particle projection image of the toner A are calculated.

Here, the degree of circularity (a) is a value expressed by L2/L1 when a circumferential length of a circle of an area (S) is set as L2 and the degree of average circularity of the toner A is calculated by averaging the circularity over all particles.

TABLE 1

| | Volume Average Particle size μm | 5 μm or less Volume % | Degree of average circularity | Degree of Circularity < 0.850 Unit % |
|---|---|---|---|---|
| Toner A | 6.8 | 10.2 | 0.955 | 2.38 |
| Toner B | 8.6 | 3.1 | 0.958 | 2.57 |
| Toner C | 7.4 | 7.1 | 0.954 | 2.10 |
| Toner D | 6.3 | 16.8 | 0.956 | 3.84 |
| Toner E | 5.7 | 20.5 | 0.951 | 2.96 |
| Toner F | 9.4 | 1.5 | 0.957 | 2.21 |
| Toner G | 6.8 | 11.4 | 0.947 | 2.85 |
| Toner H | 7.0 | 12.8 | 0.962 | 2.10 |
| Toner I | 7.2 | 12.5 | 0.935 | 3.25 |
| Toner J | 7.0 | 9.7 | 0.966 | 2.04 |
| Toner K | 7.0 | 15.3 | 0.954 | 4.12 |
| Toner L | 7.0 | 22.4 | 0.951 | 5.47 |
| Toner M | 7.5 | 6.0 | 0.958 | 1.91 |

(3) Image Density

By using a copying machine (KM-8030) made by Kyocera Mita Corporation, under a normal environment (23° C., 50% Rh), 100,000 sheets of image evaluation patterns are printed, and the initial image density and the image density after printing 100,000 sheets are evaluated in accordance with the following criteria.

That is, an initial image is obtained by printing an image evaluation pattern, and image densities which constitute image evaluation patterns are measured by using a reflection density meter (TC-6D, made by Tokyo Denshoku Co., Ltd.). To be more specific, the density is measured at arbitrary 9 points on a matted portion of the image evaluation pattern, and the average value of the density is calculated and is assumed as the image density.

Good (G): Image density of 1.3 or more is obtained.

Fair (F): Image density of 1.2 or more and less than 1.3 is obtained.

Bad (B): Image density of below 1.2 is obtained.

Further, under a high temperature and high moisture environment (32° C., 80% Rh), and under a low temperature and low moisture environment (10° C., 15% Rh), the image density is also evaluated. The obtained results are shown in Table 2 to 4.

(4) Fogging

By using a copying machine (KM-8030) made by Kyocera Mita Corporation, under a normal environment (23° C., 50% Rh), 100,000 sheets of image evaluation patterns are printed, and initial fogging and fogging after printing 100,000 sheets of image evaluation patterns are evaluated in accordance with the following criteria. Here, the fogging means the density difference between the density of a non-image-forming portion and the density of a base paper.

That is, an initial image is obtained by printing an image evaluation pattern, and the density of the non-image-forming portions having no image evaluation pattern is measured by using a reflection density meter (TC-6D, made by Tokyo Denshoku Co., Ltd.). To be more specific, the density is measured at arbitrary 9 points on the non-image-forming portions, and the average value of the density is calculated and is assumed as fogging. Further, under a high temperature and a high moisture environment (32° C., 80% Rh), and under a low temperature and low moisture environment (10° C., 15% Rh), the density is evaluated in the same manner. The obtained results are shown in Table 2 to 4.

Good (G): Density difference of below 0.008 is obtained.

Bad (B): Density difference of 0.008 or more is obtained.

(5) Image Quality

By using a copying machine (KM-8030) made by Kyocera Mita Corporation, under a normal environment (23° C., 50% Rh), 100,000 sheets of image evaluation patterns are printed, and an initial image quality and an image quality after printing 100,000 sheets are evaluated in accordance with the following criteria. Further, under a high temperature and high moisture environment (32° C., 80% Rh), and under a low temperature and low moisture environment (10° C., 15% Rh), the image quality is also evaluated. The obtained results are shown in Table 2 to 4.

Excellent (E): A clear image state in which splashing of toner is not recognized even with a magnifying glass is obtained.

Good (G): A Clear image state in which splashing of toner is not recognized with naked eyes is obtained.

Fair (F): An image state in which although splashing of toner is slightly recognized, there exists no practical problem is obtained.

Bad (B): An image state in which blurring of characters is conspicuous besides splashing of toner is obtained.

TABLE 2

| | | Image Density | | | | Fogging | | | | Image Quality | |
|---|---|---|---|---|---|---|---|---|---|---|---|
| Normal environment | | Initial | | 100,000 copy | | Initial | | 100,000 copy | | Initial | 100,000 copy |
| Example 1 | Toner A | 1.413 | G | 1.356 | G | 0.004 | G | 0.003 | G | E | E |
| Example 2 | Toner B | 1.387 | G | 1.345 | G | 0.005 | G | 0.004 | G | G | G |
| Example 3 | Toner C | 1.398 | G | 1.338 | G | 0.003 | G | 0.004 | G | G | G |
| Example 4 | Toner D | 1.355 | G | 1.316 | G | 0.004 | G | 0.005 | G | G | G |
| Comparative example 1 | Toner E | 1.396 | G | 1.296 | F | 0.004 | G | 0.006 | G | G | F |
| Comparative example 2 | Toner F | 1.327 | G | 1.221 | F | 0.005 | G | 0.002 | G | G | B |
| Comparative example 3 | Toner G | 1.333 | G | 1.264 | F | 0.003 | G | 0.003 | G | G | F |
| Comparative example 4 | Toner H | 1.408 | G | 1.334 | G | 0.004 | G | 0.004 | G | G | G |
| Comparative example 5 | Toner I | 1.385 | G | 1.311 | G | 0.004 | G | 0.004 | G | G | G |
| Comparative example 6 | Toner J | 1.411 | G | 1.368 | G | 0.005 | G | 0.006 | G | G | G |
| Comparative example 7 | Toner K | 1.395 | G | 1.275 | F | 0.004 | G | 0.006 | G | G | F |
| Comparative example 8 | Toner L | 1.397 | G | 1.291 | F | 0.005 | G | 0.006 | G | G | F |
| Comparative example 9 | Toner M | 1.403 | G | 1.365 | G | 0.005 | G | 0.006 | G | G | G |

E: Excellent,
G: Good,
F: Fair,
B: Bad

TABLE 3

| Low Temperature and Low Moisture | | Image Density | | | | Fogging | | | | Image Quality | |
|---|---|---|---|---|---|---|---|---|---|---|---|
| | | Initial | | 100,000 copy | | Initial | | 100,000 copy | | Initial | 100,000 copy |
| Example 1 | Toner A | 1.413 | G | 1.385 | G | 0.005 | G | 0.005 | G | G | G |
| Example 2 | Toner B | 1.401 | G | 1.364 | G | 0.004 | G | 0.004 | G | G | G |
| Example 3 | Toner C | 1.387 | G | 1.352 | G | 0.005 | G | 0.005 | G | G | G |
| Example 4 | Toner D | 1.368 | G | 1.308 | G | 0.003 | G | 0.003 | G | G | G |
| Comparative example 1 | Toner E | 1.396 | G | 1.312 | G | 0.005 | G | 0.006 | G | G | G |
| Comparative example 2 | Toner F | 1.327 | G | 1.245 | F | 0.004 | G | 0.003 | G | G | F |
| Comparative example 3 | Toner G | 1.333 | G | 1.236 | F | 0.004 | G | 0.002 | G | G | F |
| Comparative example 4 | Toner H | 1.394 | G | * | | 0.005 | G | * | | G | * |
| Comparative example 5 | Toner I | 1.382 | G | 1.322 | G | 0.003 | G | 0.005 | G | G | G |
| Comparative example 6 | Toner J | * | | — | | * | | — | | * | — |
| Comparative example 7 | Toner K | 1.386 | G | 1.288 | F | 0.004 | G | 0.006 | G | G | F |
| Comparative example 8 | Toner L | 1.354 | G | 1.243 | F | 0.003 | G | 0.004 | G | G | F |
| Comparative example 9 | Toner M | * | | — | | * | | — | | * | — |

*Printing test discontinued due to generation of disturbance and irregularities of the thin layer on the whole surface of the sleeve.
E: Excellent,
G: Good,
F: Fair,
B: Bad

TABLE 4

| Low Temperature and Low Moisture | | Image Density | | | | Fogging | | | | Image Quality | |
|---|---|---|---|---|---|---|---|---|---|---|---|
| | | Initial | | 100,000 copy | | Initial | | 100,000 copy | | Initial | 100,000 copy |
| Example 1 | Toner A | 1.385 | G | 1.341 | G | 0.003 | G | 0.004 | G | E | G |
| Example 2 | Toner B | 1.387 | G | 1.305 | G | 0.004 | G | 0.004 | G | G | G |
| Example 3 | Toner C | 1.401 | G | 1.286 | F | 0.003 | G | 0.003 | G | G | F |
| Example 4 | Toner D | 1.335 | G | 1.253 | F | 0.003 | G | 0.005 | G | G | F |
| Comparative example 1 | Toner E | 1.389 | G | 1.175 | B | 0.004 | G | 0.006 | G | G | B |
| Comparative example 2 | Toner F | 1.317 | G | 1.086 | B | 0.005 | G | 0.004 | G | G | B |
| Comparative example 3 | Toner G | 1.383 | G | 1.161 | B | 0.004 | G | 0.006 | G | G | B |
| Comparative example 4 | Toner H | 1.362 | G | 1.321 | G | 0.004 | G | 0.005 | G | G | G |
| Comparative example 5 | Toner I | 1.287 | F | 1.134 | B | 0.004 | G | 0.003 | G | F | B |
| Comparative example 6 | Toner J | 1.411 | G | 1.368 | G | 0.005 | G | 0.008 | B | G | F |
| Comparative example 7 | Toner K | 1.374 | G | 1.147 | B | 0.004 | G | 0.006 | G | G | B |
| Comparative example 8 | Toner L | 1.397 | G | 1.155 | B | 0.005 | G | 0.006 | G | G | B |
| Comparative example 9 | Toner M | 1.413 | G | 1.376 | G | 0.005 | G | 0.006 | G | G | G |

E: Excellent,
G: Good,
F: Fair,
B: Bad

Example 2

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by a turbo mill (made by TURBO KOGYO CO., LTD.) which is a mechanical pulverizing apparatus until the volume average particle size becomes 13.6 μm. This pulverized material is further pulverized by the above-mentioned pulverizing apparatus until the volume average particle size becomes 8.0 μm. Then, the pulverized material is classified into fine particles and coarse particles simultaneously by an air classifier thus obtaining toner particles which have a volume average particle size of 8.6 μm, contain 3.1 volume % of particles having the particle size of 5 μm or less, and an average degree of circularity of 0.958.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner B.

Then, the toner B is evaluated in the same manner as the example 1. An obtained result of the evaluation is shown in Tables 2 to 4.

Example 3

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the turbo mill (made by TURBO KOGYO CO., LTD.) which is the mechanical pulverizing apparatus until the volume average particle size becomes 11.0 μm. This pulverized material is further pulverized by the above-mentioned pulverizing apparatus until the volume average particle size becomes 6.8 μm. Then, the pulverized material is classified into fine particles and coarse particles simultaneously by an air classifier thus obtaining toner particles which have a volume average particle size of 7.4 μm, contain 7.1 volume % of particles having the particle size of 5 μm or less, and an average degree of circularity of 0.954.

Next, to 100 parts by weight of the obtained toner particles, 0.75 parts by weight of hydrophobic silica (product name: RA200H, made by NIPPON AEROSIL CO., LTD.) is added and mixed by a Henschel mixer thus producing toner C.

Then, the toner C is evaluated in the same manner as the example 1. An obtained result of the evaluation is shown in Tables 2 to 4.

Example 4

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the turbo mill (made by TURBO KOGYO CO., LTD.) which is the mechanical pulverizing apparatus until the volume average particle size becomes 11.0 μm. This pulverized material is further pulverized by the above-mentioned pulverizing apparatus until the volume average particle size becomes 5.7 μm. Then, the pulverized material is classified into fine particles and coarse particles simultaneously by an air classifier thus obtaining toner particles which have a volume average particle size of 6.3 μm, contain 16.8 volume % of particles having the particle size of 5 μm or less, and an average degree of circularity of 0.956.

Next, to 100 parts by weight of the obtained toner particles, 0.9 parts by weight of hydrophobic silica (product name: RA200H, made by NIPPON AEROSIL CO., LTD.) is added and mixed by a Henschel mixer thus producing toner D.

Then, the toner D is evaluated in the same manner as the example 1. An obtained result of the evaluation is shown in Tables 2 to 4.

Comparison Example 1

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the turbo mill (made by TURBO KOGYO CO., LTD.) which is the mechanical pulverizing apparatus until the volume average particle size becomes 10.5 μm. This pulverized material is further pulverized by the above-mentioned pulverizing apparatus until the volume average particle size becomes 6.6 μm. Then, the pulverized material is classified into fine particles and coarse particles simultaneously by an air classifier thus obtaining toner particles which have a volume average particle size of 5.7 μm, contain 20.5 volume % of particles having the particle size of 5 μm or less, and an average degree of circularity of 0.951.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner E.

Then, the toner E is evaluated in the same manner as the example 1. An obtained result of the evaluation is shown in Tables 2 to 4.

Comparison Example 2

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the turbo mill (made by TURBO KOGYO CO., LTD.) which is the mechanical pulverizing apparatus until the volume average particle size becomes 12.0 μm. This pulverized material is further pulverized by the above-mentioned pulverizing apparatus until the volume average particle size becomes 8.8 μm. Then, the pulverized material is classified into fine particles and coarse particles simultaneously by an air classifier thus obtaining toner particles which have a volume average particle size of 9.4 μm, contain 1.5 volume % of particles having the particle size of 5 μm or less, and an average degree of circularity of 0.957.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner F.

Then, the toner F is evaluated in the same manner as the example 1. An obtained result of the evaluation is shown in Tables 2 to 4.

Comparison Example 3

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the turbo mill (made by TURBO KOGYO CO., LTD.) which is the mechanical pulverizing apparatus until the volume average particle size becomes 12.0 μm. This pulverized material is further pulverized by the above-mentioned pulverizing apparatus until the volume average particle size becomes 6.4 μm. Then, the pulverized material is classified into fine particles and coarse particles simultaneously by an air classifier thus obtaining toner particles which have a volume average particle size of 6.8 μm, contain 11.4 volume % of particles having the particle size of 5 μm or less, and an average degree of circularity of 0.947.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner G.

Then, the toner G is evaluated in the same manner as the example 1. An obtained result of the evaluation is shown in Tables 2 to 4.

Comparison Example 4

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the turbo mill (made by TURBO KOGYO CO., LTD.) which is the mechanical pulverizing apparatus until the volume average particle size becomes 14.0 μm. This pulverized material is further pulverized by the above-mentioned pulverizing apparatus until the volume average particle size becomes 11.0 μm. Then, this pulverized material is further pulverized by the above-mentioned pulverizing apparatus until the volume average particle size becomes 9.5 μm and, still further, this pulverized material is pulverized until the volume average particle size becomes 6.6 μm in the same manner. Thereafter, the pulverized material is classified into fine particles and coarse particles simultaneously by an air classifier thus obtaining toner particles which have a volume average particle size of 7.0 μm, contain 12.8 volume % of particles having the particle size of 5 μm or less, and an average degree of circularity of 0.962.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner H.

Then, the toner H is evaluated in the same manner as the example 1. An obtained result of the evaluation is shown in Tables 2 to 4.

Comparison Example 5

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by a jet-type pulverizing apparatus until the volume average particle size becomes 11.0 μm. This pulverized material is further pulverized by the jet-type pulverizing apparatus until the volume average particle size becomes 6.6 μm. Then, the pulverized material is classified into fine particles and coarse particles simultaneously by an air classifier thus obtaining toner particles which have a volume average particle size of 7.2 μm, contain 12.5 volume % of particles having the particle size of 5 μm or less, and an average degree of circularity of 0.935.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner I.

Then, the toner I is evaluated in the same manner as the example 1. An obtained result of the evaluation is shown in Tables 2 to 4.

Comparison Example 6

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the jet-type pulverizing apparatus until the volume average particle size becomes 14.0 μm. This pulverized material is further pulverized by the above-mentioned pulverizing apparatus until the volume average particle size becomes 11.0 μm.

Then, this pulverized material is further pulverized by the above-mentioned pulverizing apparatus until the volume average particle size becomes 9.5 μm and, still further, this pulverized material is pulverized until the volume average particle size becomes 6.4 μm in the same manner. Thereafter, the pulverized material is classified into fine particles and coarse particles simultaneously by an air classifier thus obtaining toner particles which have a volume average particle size of 7.0 Ξm, contain 9.7 volume % of particles having the particle size of 5 μm or less, and an average degree of circularity of 0.966.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner J.

Then, the toner J is evaluated in the same manner as the example 1. An obtained result of the evaluation is shown in Tables 2 to 4.

Comparison Example 7

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the jet-type pulverizing apparatus until the volume average particle size becomes 10.0 μm. This pulverized material is further pulverized by the above-mentioned pulverizing apparatus until the volume average particle size becomes 6.7 μm. Then, the pulverized material is classified into fine particles and coarse particles simultaneously by an air classifier and, thereafter, only the coarse particles out of the above-mentioned classified material are further classified thus obtaining toner particles which have a volume average particle size of 7.0 μm, contain 15.3 volume % of particles having the particle size of 5 μm or less, and an average degree of circularity of 0.954.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner K.

Then, the toner K is evaluated in the same manner as the example 1. An obtained result of the evaluation is shown in Tables 2 to 4.

Comparison Example 8

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the jet-type pulverizing apparatus until the volume average particle size becomes 10.0 μm. This pulverized material is further pulverized by the above-mentioned pulverizing apparatus until the volume average particle size becomes 7.4 μm. Then, the pulverized material is classified into fine particles and coarse particles by an air classifier thus obtaining toner particles which have a volume average particle size of 7.0 μm, contain 22.4 volume % of particles having the particle size of 5 μm or less, and an average degree of circularity of 0.951.

Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner L.

Then, the toner L is evaluated in the same manner as the example 1. An obtained result of the evaluation is shown in Tables 2 to 4.

Comparison Example 9

Influences which are brought about by the change of particle size and the degree of circularity of the toner particles are studied.

That is, first of all, the molten mixed material which is produced in the same manner as the toner A is cooled and, thereafter, the cooled molten mixed material is pulverized by the jet-type pulverizing apparatus until the volume average particle size becomes 11.0 μm. This pulverized material is further pulverized by the above-mentioned pulverizing apparatus until the volume average particle size becomes 6.0 μm. Then, the pulverized material is classified into fine particles and coarse particles simultaneously by the air classifier thus obtaining toner particles which have a volume average particle size of 6.5 μm, contain 12.0 volume % of particles having the particle size of 5 μm or less and, thereafter, the only coarse particles are classified thus obtaining toner particles which have an average degree of circularity of 0.958, a volume average particle size of 7.5 μm, contain 6.0 volume % of particles having the particle size of 5 μm or less. Next, to 100 parts by weight of the obtained toner particles, 0.8 parts by weight of hydrophobic silica (product name: RA200H, made by NIPPON AEROSIL CO., LTD.) is added and mixed by a Henschel mixer thus producing toner M.

Then, the toner M is evaluated in the same manner as the example 1. An obtained result of the evaluation is shown in Tables 2 to 4.

In the examples 1 to 4, the average particle size of the toner particles is 6 to 9 μm, the content of toner particles having the particle size of 5 μm or less assumes a value equal to 20 volume % or less with respect to the total quantity of the toner particles, the average degree of circularity of the toner particles is 0.950 to 0.960, the content of toner particles having the degree of circularity of below 0.850 assumes a value which falls within a range from 2.0 to 4.0 unit % with respect to the total quantity of toner particles. Accordingly, it is possible to obtain a favorable image in a normal environment (23° C., 50% RH), a high temperature and high moisture environment (32° C., 80% RH) and a low temperature and low moisture environment (10° C., 15% RH)

On the other hand, in the comparison example 1, since the content of the toner particles having the particle size of 5 μm or less is large, under a high temperature and high moisture environment where the agitating and conveying performances are decreased, a sufficient image density is not obtained, and stripes are also generated on the developing sleeve.

In the comparison example 2, since the average particle size of the toner particles is large, the image quality is degraded.

In the comparison examples 3 and 5, since the degree of average circularity of the toner particle is small, the fluidity of the toner is lowered, and hence, the toner adheres to the spiral part whereby the supply of toner to the developer carrying body becomes insufficient thus lowering the image density.

In the comparison examples 4 and 6, since the degree of average circularity of the toner particle is large, the adjustment of charging of the toner becomes difficult. In particular, under a low temperature and low moisture environment, since an adhesive force of the toner with the developing sleeve which is made of stainless steel becomes too strong, an immobile layer of the toner is formed on the developing sleeve and hence, the disturbance of a thin layer is generated.

In the comparison examples 7 and 8, since the content of the toner particles having the circularity of below 0.850 is large, the sufficient transfer efficiency is not obtained and, at the same time, the toner is deteriorated due to a stress generated by a spiral member or a toner removing member and hence, stripes are generated on a thin layer formed on the developing sleeve.

In the comparison example 9, since the content of the toner particles having the circularity of below 0.850 is extremely small, the charging of the toner particles is increased. In particular, under a low temperature and low moisture environment, since an adhering force of the toner with the developing sleeve made of stainless steel becomes excessively strong, an immobile layer of the toner is formed on the developing sleeve and hence, the disturbance of the thin layer is generated.

What is claimed is:

1. A developing unit comprising: a magnetic monocomponent developer which includes a developing vessel which accommodates a magnetic monocomponent developer therein, a developer carrying body which carries the magnetic monocomponent developer and conveys the magnetic monocomponent developer to a developing region, and a developer layer thickness restricting member which restricts a layer thickness of the magnetic monocomponent developer, wherein the magnetic monocomponent developer includes toner particles which contain at least a first polyester resin having a weight average molecular weight within a range from $1.0\times10^4$ to $5.0\times10^4$ and a second polyester resin having a weight average molecular weight within a range from $1.0\times10^6$ to $5.0\times10^6$ as a binder resin and magnetic powder, and also includes following constitutions (a) to (c):

(a) an average particle size of the toner particles being set to a value which falls within a range from 6 to 9 μm;

(b) an average degree of circularity of the toner particles being set to a value which falls within a range from 0.950 to 0.960; and (c) a content of the toner particles having a degree of circularity of below 0.850 being set to a value which falls within a range from 2.0 to 4.0 unit % with respect to a total quantity of the toner particles.

2. The developing unit according to claim 1, wherein a content of the toner particles having the particle size of 5 μm or less is set to a value which falls within a range of 20 volume % or less with respect to a total quantity of the toner particles.

3. The developing unit according to claim 1, wherein a softening point of the first polyester resin is set to a value of below 120° C. and, at the same time, a softening point of the second polyester resin is set to 120° C. or more.

4. The developer unit according to claim 1, wherein the first binder resin and the second binder resin are respectively formed of a first polyester resin and a second polyester resin, wherein an acid value of the first polyester resin is below 6 mgKOH/g and, at the same time, an acid value of the second polyester resin is equal to or above 6 mgKOH/g.

5. The developing unit according to claim 1, wherein the toner further contains hydrophobic silica as an additive agent and, at the same time, an addition quantity of the hydrophobic silica is set to a value which falls within a range from 0.5 to 2.0 weight % with respect to the total quantity of the toner.

6. The developing unit according to claim 1, wherein the toner particles are formed by a pulverizing method.

* * * * *